United States Patent [19]

Vonk

[11] Patent Number: 5,062,625

[45] Date of Patent: Nov. 5, 1991

[54] HAND EXERCISER

[76] Inventor: Jan C. M. Vonk, 754 Adelaide St. West, Toronto, Ontario, Canada, M6J 1B3

[21] Appl. No.: 406,554

[22] Filed: Sep. 13, 1989

[51] Int. Cl.[5] ..... A63B 23/16

[52] U.S. Cl. ..... 272/67; 272/68

[58] Field of Search ..... 272/67, 68, 137, 139; 128/26; D21/221, 222

[56] References Cited

U.S. PATENT DOCUMENTS

| | | | |
|---|---|---|---|
| 1,472,906 | 11/1923 | Gorrell | 272/67 |
| 3,612,521 | 10/1971 | Wendeborn | D24/36 X |
| 4,033,580 | 7/1977 | Paris | 272/137 |
| 4,679,799 | 7/1987 | Coletti | 272/67 X |
| 4,730,827 | 3/1988 | Williams | 272/67 X |
| 4,828,249 | 5/1989 | Keating | 272/68 |

*Primary Examiner*—Richard J. Apley
*Assistant Examiner*—Jerome W. Donnelly

[57] ABSTRACT

The hand exerciser is made of a resilient material and has a number of finger engaging ports each connected to one side of a body portion by bridging segments. The body portion to the side thereof opposite the finger engaging ports includes a thumb engaging port. The hand exerciser is particularly useful for strengthening of the muscles used during the extension of the fingers and movement of the thumb in a generally rearwardly direction. The exerciser is preferably made of a one piece rubber material and can easily be produced by moulding.

11 Claims, 2 Drawing Sheets

HAND EXERCISER

FIELD OF THE INVENTION

The present invention relates to hand exercisers and particularly to hand exercisers which require the extension of the fingers.

BACKGROUND OF THE INVENTION

It is often necessary to strengthen certain muscles associated with hand movement and a number of devices have been proposed for strengthening of the muscles used to move the fingers and thumb into a clasped position. There is a second group of muscles which are associated with control of the fingers outwardly to a fully extended position.

A number of prior art hand exercisers used in the extension movement of the fingers are disclosed in the following U.S. Pat. Nos.: 3,612,521; 4,679,799; 4,615,522; 3,944,220; and 1,472,9106.

U.S. Pat. No. 3,612,521 uses finger and thumb engaging ports located in an elastic body, but does not have the required cooperation between the ports for the desired finger extension, nor the somewhat independent action of the fingers during extension, such that each finger acts generally independently against the thumb movement.

SUMMARY OF THE INVENTION

A hand exerciser according to the present invention comprises a resilient material having finger engaging ports, each of which are connected to one side of a body portion by a bridging segment. The body portion to the side thereof opposite said one side includes a thumb engaging port. This hand exerciser is particularly useful in developing the muscles associated with the extension movement of the fingers and can also be used in rehabilitation applications.

According to an aspect of the invention, the finger engaging ports of the hand exerciser are laid out in an arced pattern.

According to a further aspect of the invention, the thumb port is generally on a line passing between the middle finger ports.

According to yet a further aspect of the invention, the hand exerciser is generally symmetrically about a line passing between the middle finger ports and through the thumb port.

BRIEF DESCRIPTION OF THE DRAWINGS

Preferred embodiments of the invention are shown in the drawings, wherein.

DETAILED DESCRIPTION OF THE PREFERRED EMBODIMENTS

The hand exerciser, generally shown as 2, has a number of finger engaging ports 4 connected to body portion 6 by means of bridge segments 8. The body portion to the opposite side of the finger engaging ports includes a thumb port, generally shown as 10.

Figure 1:
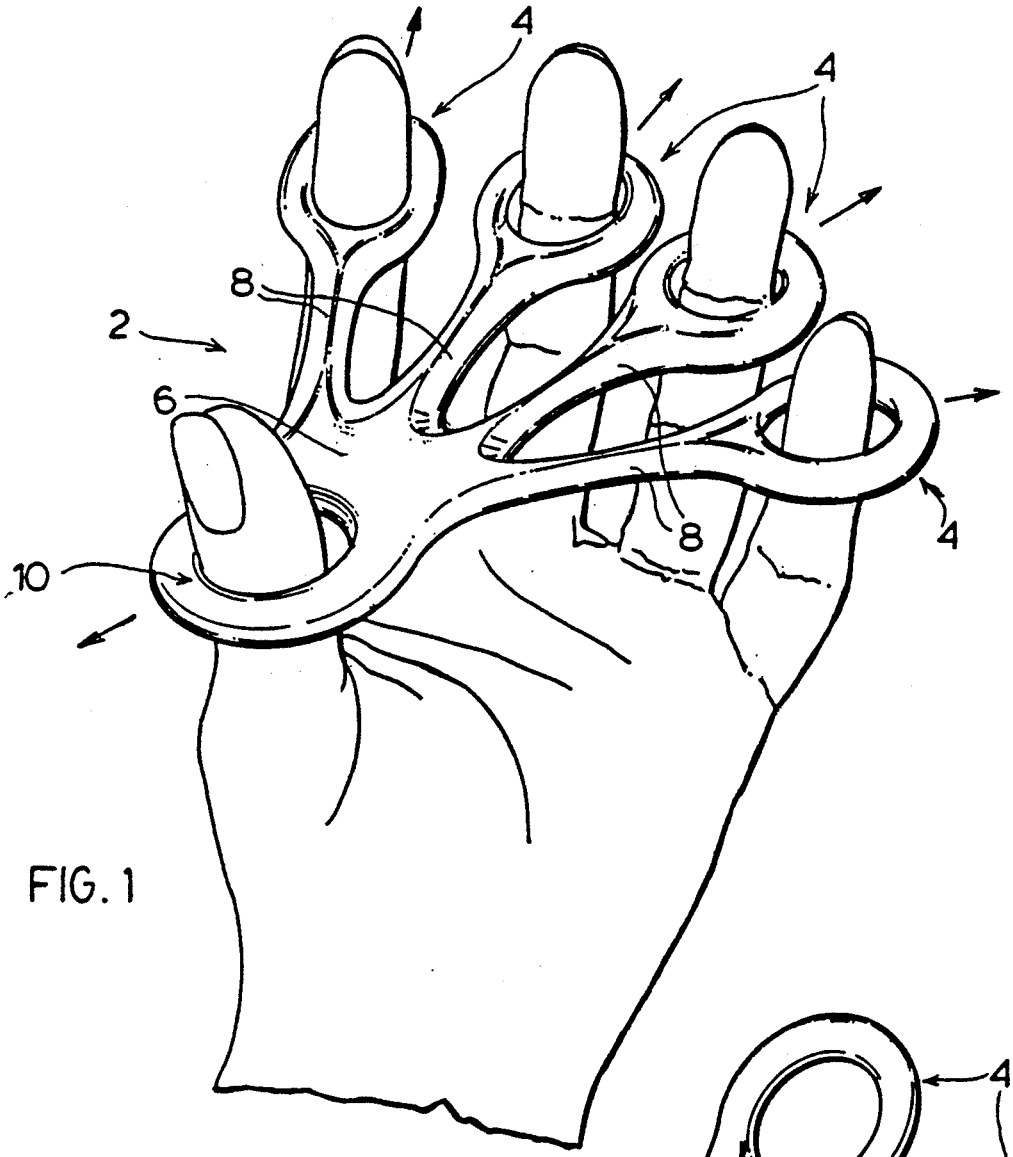
FIG. 1 is a partial perspective view of the hand exerciser in use.

The hand exerciser is made of a resilient material, preferably a rubber or natural rubber material or other suitable elastomeric material, which has a surface which can easily be cleaned or sterilized. It can be appreciated that this hand exerciser can be used in hospital environments, as one possibility, and therefore the device must be hygenically acceptable. The finger engaging ports 4 are generally of an oval shape and are sized to loosely engage the fingertips as generally shown in FIG. 1. These oval ports are oversized to allow the device to slide down on the fingers, as generally indicated as 5, to exercise a different part of the fingers or to change the required strength for carrying out the exercise.

The individual bridge segments 8 allow each finger to act independently or essentially independently of the other fingers whereby the user cannot merely use the strength in two fingers for movement of the entire exerciser. In addition, the location of the thumb port 10 forces a particular action on the hand which is desired. This hand exerciser is primarily designed for keeping the thumb in a somewhat interior position and allowing the fingers to be fully extended. The action of spreading the thumb to provide a fully spread hand is not always desirable, although it can be used with the present device. The placement of the thumb port makes it more convenient for the initial extension of the fingers with the thumb being maintained in a somewhat downwardly position and providing the resisting force.

Figure 3:
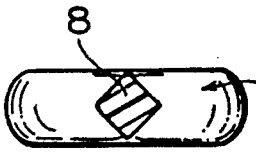
FIG. 3 is a cross sectional view taken along line 3—3 of FIG. 2.
Figure 2:
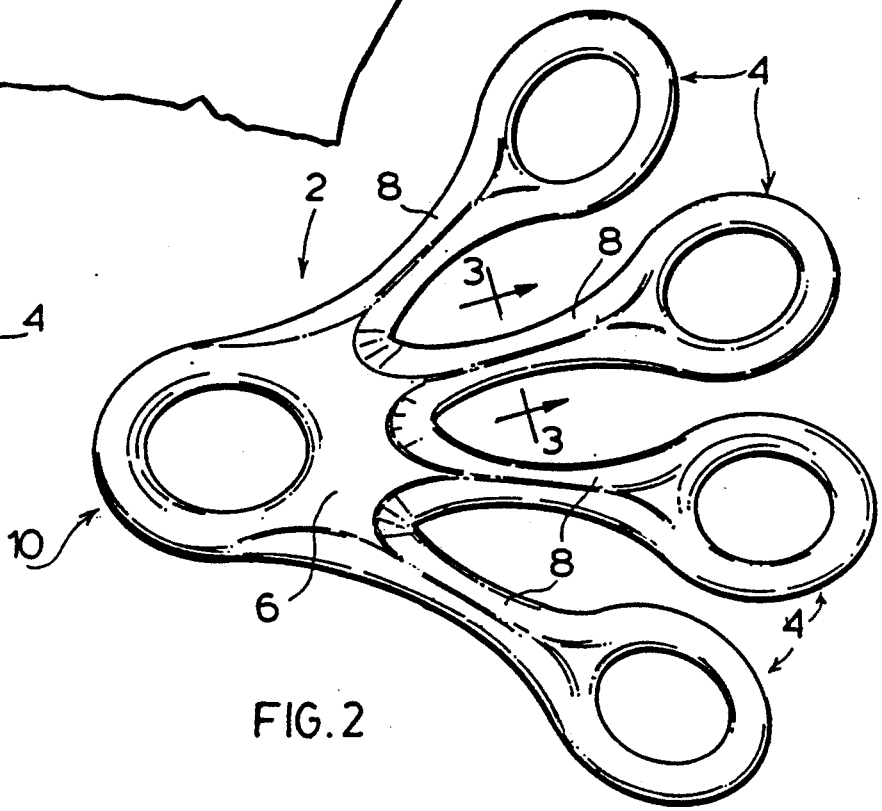
FIG. 2 is a top view of the hand exerciser.
Figure 4:
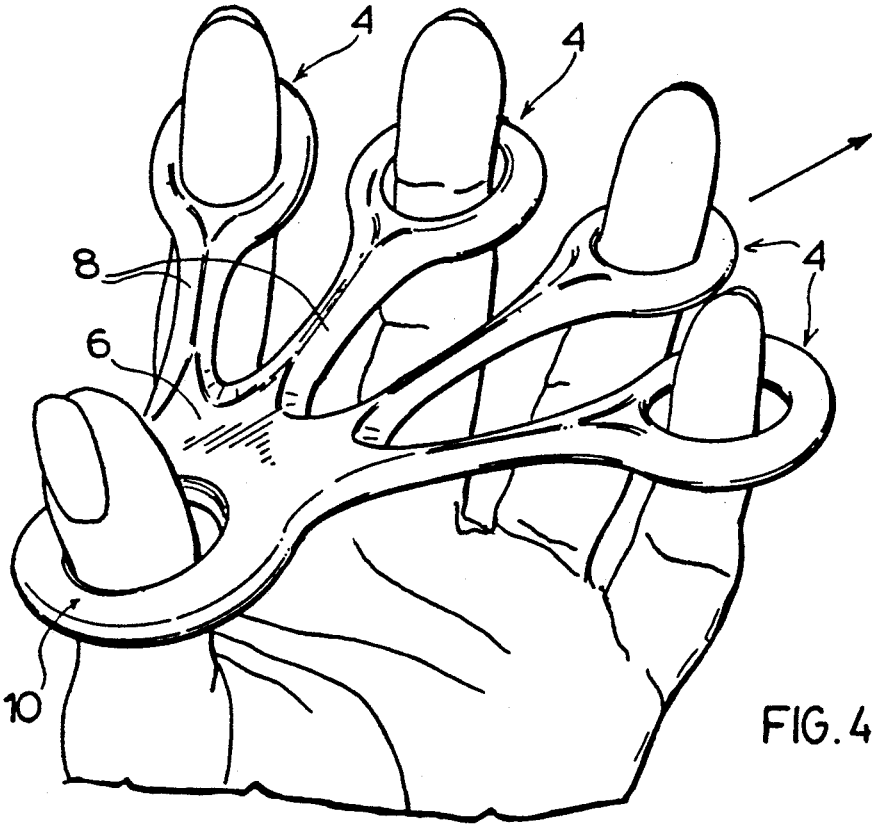
FIG. 4 is a partial perspective view showing the hand exerciser gripping the finger tips and the thumb tip of a user during an extension action of the fingers.
Figure 5:
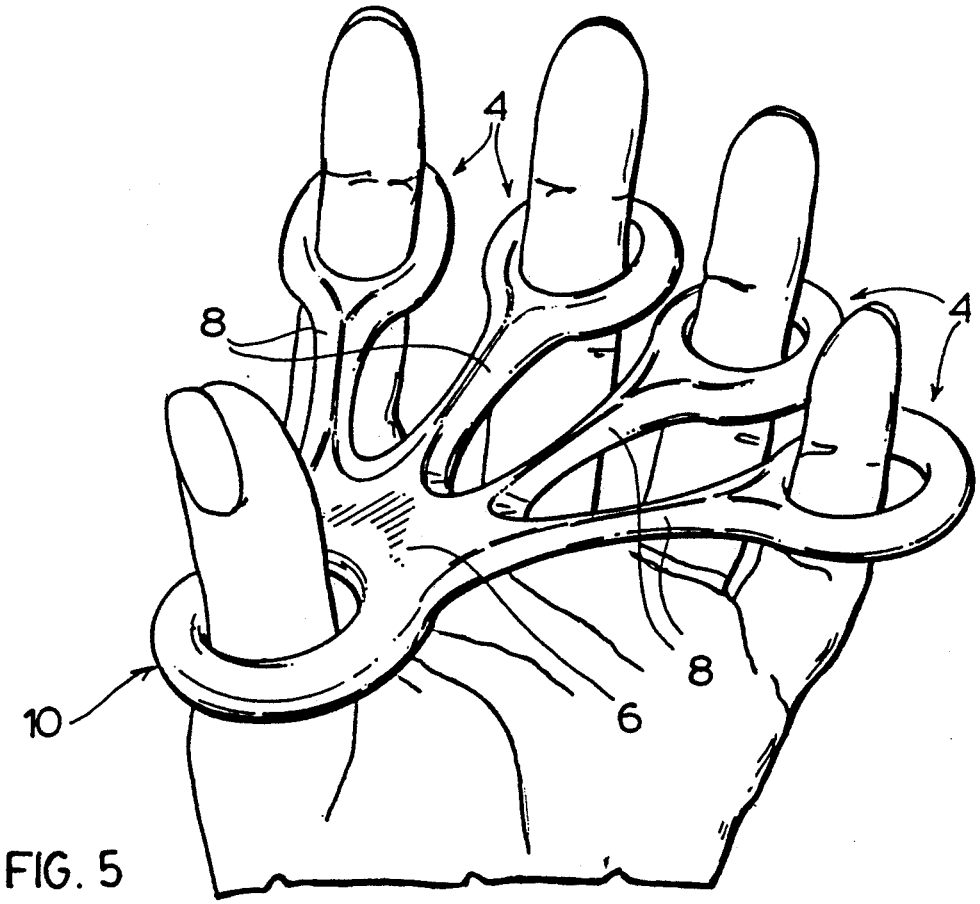
FIG. 5 shows the hand exerciser where the exerciser has been placed closer to the finger knuckles of a user.

The bridge segments, as generally shown in FIG. 3, are of a rectangular-like section and include a narrow portion intermediate the finger ports and the body portion 6 which expands during the extension of the fingers, thus accommodating individual finger extension. In addition, some material is drawn from the body portion 6 which serves each of the individual bridge segments 8. As can be appreciated, the material about the finger ports 4 also extends during extension of the fingers and, similarly, the material to the far side of the thumb port also extends during extension of the fingers.

The placement of the finger ports relative to the centrally located thumb port and the length of the bridge segments 8 are variable, depending upon the particular application. For example, a very small hand would obviously use a smaller hand exerciser and it may also be desirable to reduce the length of the bridge segments 8 to allow the hand to start in a more clasped position and fully extend from this clasped position.

In addition to varying the dimensions of the hand exerciser, it is also possible to produce exercisers of different strength levels merely by varying the resilient material used. For example, it may be desirable to have a very low energy exerciser which can be used during the start of a rehabilitation program and progressively advance through various levels of exercisers until a full strength exerciser could be used. This degree of difficulty can be controlled by the material of the hand exerciser and the density thereof. A further variation involves using two stacked exercisers to increase the difficulty and optionally exercise somewhat different muscles. For example, one of the exercisers can engage at the knuckles and the other exerciser engage at the finger tips.

The hand exerciser, as generally shown, is symmetrical about a line passing between the middle finger ports and through the thumb port. This symmetrical configuration places the thumb in the desired position for full extension of the fingers. The hand movement desired to be achieved with the exerciser is generally shown in FIG. 1. Thus, it can be seen that the thumb is trying to move somewhat rearwardly relative to the user's arm and the fingers are being fully extended. The movement of the thumb to the side of the hand is generally not desired.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A hand exerciser comprising an elastomeric material having a plurality of finger engaging ports each connected to a respective elongate bridging segment with the bridging segments being connected to and extending outwardly from one side of a body portion spacing said finger engaging ports from said body portion, and wherein, in an unstressed state of said exerciser, said body portion to the side of said body portion opposite said one side including a thumb engaging port.

2. A hand exerciser as claimed in claim 1, wherein said finger engaging ports are laid out in an arced pattern.

3. A hand exerciser as claimed in claim 2, wherein said body portion provides a wide area of substantial mass separating said bridging segments from said thumb port which undergoes stress due to the force exerted on said finger ports and said thumb port when said device is used.

4. A hand exerciser as claimed in claim 3, wherein said bridging segments accommodate generally individual finger movement by providing a resisting force opposing the separating movement between the respective finger port and said thumb port.

5. A hand exerciser as claimed in claim 4, wherein said hand exerciser is made of a rubber like material.

6. A hand exerciser as claimed in claim 4, wherein said rubber like material is non-cellular.

7. A hand exerciser as claimed in claim 6, wherein said bridge segments are of a generally rectangular section.

8. A hand exerciser as claimed in claim 7, wherein said exerciser is made of natural rubber.

9. A hand exerciser as claimed in claim 1, wherein said finger ports have two middle finger ports and said thumb port is generally on a line passing between the middle finger ports.

10. A hand exerciser as claimed in claim 1, wherein said finger ports have two middle finger ports and said exerciser is generally symmetrical about a line passing between said two middle finger ports and through said thumb port.

11. A hand exerciser as claimed in claim 1, wherein said thumb port is centrally located relative to said finger ports and offset therefrom.

* * * * *